United States Patent [19]

Eriksson

[11] Patent Number: 4,922,732

[45] Date of Patent: May 8, 1990

[54] EVAPORATOR SYSTEM FOR REFRIGERATION SYSTEMS

[75] Inventor: Leif B. Eriksson, Nilosia, Cyprus

[73] Assignee: Dyna-Manufacturing, Ltd., Cyprus

[21] Appl. No.: 439,615

[22] Filed: Nov. 20, 1989

[51] Int. Cl.[5] ..... F25B 41/00

[52] U.S. Cl. ..... 62/525; 62/527; 165/174

[58] Field of Search ..... 62/527, 525; 165/174

[56] References Cited

U.S. PATENT DOCUMENTS

| | | | |
|---|---|---|---|
| 1,798,824 | 3/1931 | White | 165/174 X |
| 1,868,611 | 7/1932 | Larsen | 62/527 |
| 1,922,581 | 8/1933 | Glover et al. | 165/174 X |
| 2,084,755 | 6/1937 | Young, Jr. | 62/525 X |
| 2,143,565 | 1/1939 | Mineo | 62/525 X |
| 2,461,876 | 2/1949 | Boyle | 62/525 |
| 2,803,116 | 8/1957 | Tilney | 62/525 X |
| 3,406,716 | 10/1968 | Cornels et al. | 62/527 X |
| 4,524,823 | 6/1985 | Hummel et al. | 62/527 X |
| 4,543,802 | 10/1985 | Ingelmann et al. | 62/525 |
| 4,593,539 | 6/1986 | Humpolik et al. | 62/527 X |

FOREIGN PATENT DOCUMENTS

| | | | |
|---|---|---|---|
| 199725 | 9/1923 | United Kingdom | 165/174 |

*Primary Examiner*—William E. Tapolcai
*Attorney, Agent, or Firm*—Charles J. Prescott

[57] ABSTRACT

An improved evaporator system for refrigeration systems, especially in environments where available space is restricted, the improvement including an inlet manifold disposed between an evaporator coil, which has a plurality of evaporator tubes, and a refrigerant expansion device. The inlet manifold is structured for more uniformly consistent and homogeneous composition of refrigerant received from the expansion device and delivered by the inlet manifold into each evaporator tube. The inlet manifold includes an elongated, endless refrigerant path through which refrigerant received from the expansion device circulates. The passageway has an elongated first portion spaced apart from, and generally coextensive with, an elongated second portion. Each of a plurality of inlet manifold outlets disposed in the first portion are connected to one of the plurality of the evaporator tubes. This uniquely structured inlet manifold thus insures a more homogeneous mix of liquid and gas refrigerant circulating within the inlet manifold to be consistently delivered into each evaporator tube for more uniform cooling over the entire surface of the evaporator coil.

8 Claims, 1 Drawing Sheet

EVAPORATOR SYSTEM FOR REFRIGERATION SYSTEMS

BACKGROUND OF THE INVENTION

This invention relates generally to air conditioner evaporator systems, and more particularly to an improved coolant inlet manifold for distribution of coolant into an evaporator coil.

In many refrigeration or air conditioning systems, the cooling or evaporator coil of such systems includes a plurality of coils connected together in parallel wherein the coolant or refrigerant is divided within a distribution head or manifold connected between the coils and an expansion device such as an expansion valve which receives compressed refrigerant for metered flow into the inlet manifold. These parallel evaporator tubes are useful in reducing resistance to refrigerant flow and increase the overall efficiency of the evaporator coil. Reduced resistance or friction to refrigerant flow is useful as it avoids build-up of pressure which causes the liquid refrigerant to boil at the resulting elevated temperature thereby reducing cooling efficiency of the evaporator coil.

Even though these evaporator coils having parallel flow tubes do indeed reduce resistance to refrigerant flow, nonetheless, because each tube does not receive refrigerant of the same homogeneous blend of liquid and gaseous from conventional inlet manifolds, at least a portion of the surface of the coil is less efficient.

Many efforts have been made to resolve this problem and to ensure that a more uniform and optimum homogeneous blend of gas and liquid refrigerant is continuously introduced into all parallel tubes within the evaporator coil. An early invention of J. Boyle is disclosed in U.S. Pat. No. 2,461,876 which is generally to a uniquely shaped housing wherein refrigerant flow is disbursed by a conical-tipped member which includes downstream apertures for introduction of the refrigerant into each of the evaporator coils.

A somewhat later device is disclosed in U.S. Pat. No. 4,543,802 to Ingelmann which is directed to the addition of a mixing means disposed between the inlet manifold or flow divider and the expansion valve. Another device or system intended to at least partially address this problem with respect to automotive air conditioners is disclosed in U.S. Pat. No. 4,593,539 to Humpolik, et al. which discloses a uniquely shaped manifold having an initial elongated quieting section through which the refrigerant flows after which the flow is reversed and distributed through a plurality of spiraling sections for distribution through each evaporator tube of the evaporator coil.

Applicant is also aware of the West German Pat. No. 382 233 B to Hercog which appears to disclose a counterflow arrangement of refrigerant through the refrigerant coils at the evaporator coils.

The present invention provides a simpler and improved inlet manifold which provides for the continuous mixing and blending of the refrigerant whereby an even, uniform distribution of the refrigerant is provided into each tube of the evaporator coil so that efficiency of the evaporator coil is increased.

BRIEF SUMMARY OF THE INVENTION

This invention is directed to an improved evaporator system for refrigeration systems, especially in environments where available space is restricted, the improvement including an inlet manifold disposed between the evaporator coil, which has a plurality of evaporator tubes, and the expansion device. The inlet manifold is structured for more uniformly consistent and homogeneous composition of refrigerant received from the expansion device delivered by the inlet manifold into each evaporator tube. The inlet manifold includes an elongated, endless refrigerant path through which refrigerant received from the expansion valve circulates. The preferred embodiment has the passageway having an elongated first portion spaced parallel and generally coextensive with an elongated second portion. Each of a plurality of inlet manifold outlets disposed in the first portion are connected to one of the plurality of the evaporator tubes. This uniquely structured inlet manifold thus insures a more homogeneous mix of liquid and gas refrigerant circulating within the inlet manifold to be consistently delivered into each evaporator tube for more uniform cooling over the entire surface of the evaporator coil.

It is therefore an object of this invention to provide a more efficient evaporator assembly for refrigeration systems having an improved inlet manifold for the uniform distribution of homogeneous quantities of refrigerant received from the expansion device and distributed into all of the tubes of the evaporator coil.

In accordance with these and other objects which will become apparent hereinafter, the instant invention will now be described with reference to the accompanying drawings.

DETAILED DESCRIPTION OF THE INVENTION

The environment in which applicant's invention resides and functions is the well-known refrigeration system, e.g. an air conditioning system utilizing freon as a refrigerant, and wherein a compressor is utilized to liquefy the refrigerant which then flows into a liquid refrigerant expansion device such as an expansion valve which meters the compressed liquid refrigerant therethrough for distribution into an evaporator coil assembly. To gasify the refrigerant, heat is absorbed by the evaporator coil from the surrounding and passing ambient air, which is thus cooled by the evaporator coil. Applicant's invention is positioned within the flow of refrigerant between the expansion valve and the evaporator coil assembly.

Figure 1:
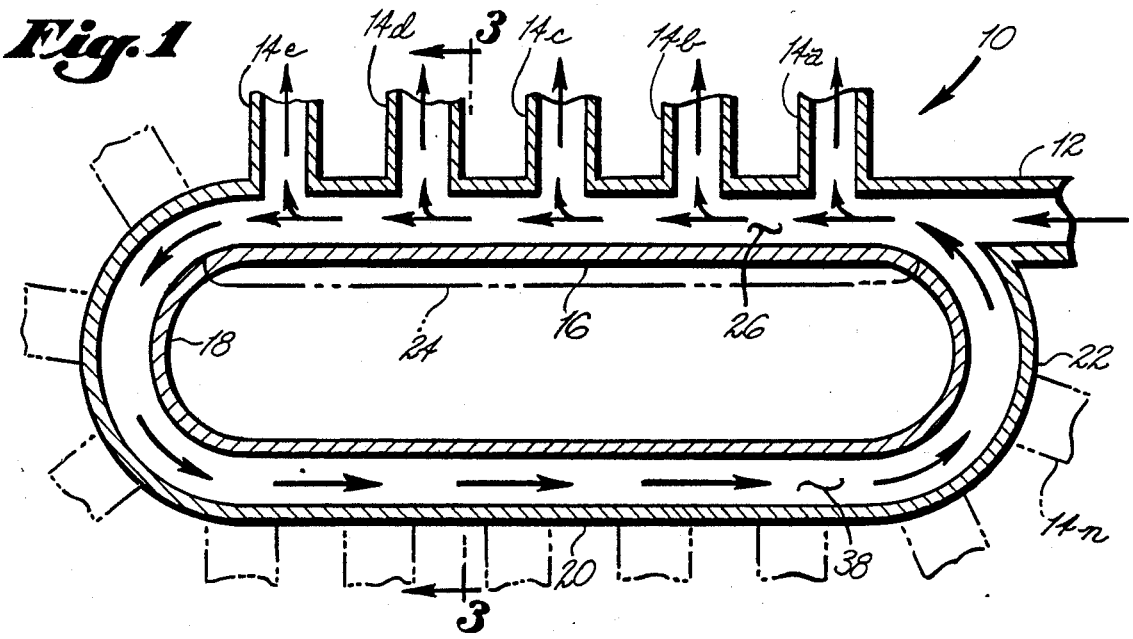
FIG. 1 is a longitudinal section view of the preferred embodiment of the inlet manifold shown positioned between the plurality of evaporator tubes and the refrigerant inlet from the expansion valve with an alternate embodiment shown in phantom.
Figure 3:
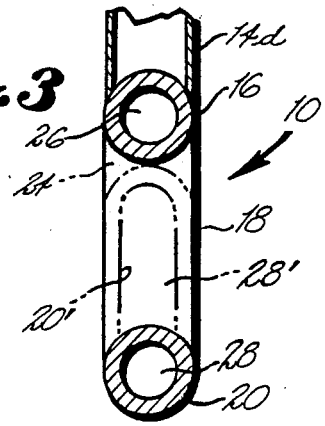
FIG. 3 is a section view in the direction of arrows 3—3 in FIG. 1.

Referring now to the drawings and particularly to FIGS. 1 and 3, the preferred embodiment of the invention is shown generally at numeral 10. The inlet manifold 10 includes an inlet tube 12 which is operably connected to receive refrigerant flowing from the expansion valve (not shown) into the inlet 12 in the direction of the arrow there.

The inlet manifold 10 is generally shaped as an elongated and flattened "0" having a first tubular portion 16 and a second tubular portion 20. These first and second portions 16 and 20, respectively are generally coextensive and are interconnected at their ends by curved tubular portions 18 and 22 as shown in FIG. 1. To function as conceived by applicant, the first portion 16 is ideally directly adjacent the second portion 20; however, angular or horizontal orientation rather than upright orientation as shown in FIG. 3 of first and second portions 16 and 20, respectively will achieve acceptable results.

A plurality of outlet tubes 14*a* . . . 14*e* are connected to the plurality of evaporator tubes within the evaporator coil. Thus, in operation, refrigerant flowing from the expansion valve enters the inlet tube 12 and flows into passageway portion 26 formed by first portion 16 and begins to circulate in the direction of the arrows toward and through curved tubular portion 18 to passageway portion 28 formed by second portion 20. Thereafter, the refrigerant is returned within curved tubular portion 22 back for reentry into passageway portion 26 to be blended and mixed with incoming refrigerant through inlet 12.

By this arrangement, then, refrigerant entering inlet 12, being in both a gaseous and liquid state, is forced to circulate around the inlet manifold 10 in the direction of the arrows. If arranged in upright orientation between the first portion 16 and the second portion 20 as shown in FIG. 3, some of the liquid refrigerant tends to collect in second portion 20. However, as the blend of liquid and gas refrigerant flows around the circuit described, regardless of angular orientation, the refrigerant will tend to become quite homogeneous in nature wherein all of the refrigerant carried through passageway portion 26 of first portion 16 is fully homogeneous and consistent along this entire length.

Thus, once this system is stabilized in its running mode, the refrigerant which exits passageway portion 26 into outlets 14*a* . . . 14*e* is uniform and homogeneous from one outlet 14*a* to another 14*b* . . . 14*e*. This homogeneous and uniform dispensing of the refrigerant into the plurality of evaporator tubes though outlets 14*a* . . . 14*e* thus achieves uniform cooling across the entire surface of the evaporator coil. Further, because of the unique circulating feature of the refrigerant provided by the invention 10, the refrigerant is more homogeneous in nature whereby the cooling effect of the refrigerant charges exiting the passageway portion 26 is more ideally blended with respect to the proportion and homogeneity of liquid and gas refrigerant.

An alternate embodiment is shown in phantom in FIG. 1 wherein outlets 14*a* . . . 14*e* continue along the entire length of all portions of the inlet manifold 10. This increased number of outlets 14*a* . . . 14*n* are provided to accommodate unique configurations of evaporator coils and is facilitated because of the extremely homogeneous nature of the refrigerant flowing through the inlet manifold 10.

Another embodiment of the inlet manifold 10 is shown in phantom in FIGS. 1 and 3 wherein partition 24 is provided which results in an enlarged second portion 20' shown in phantom in FIG. 3. This alternate embodiment provides an enlarged second passageway portion 28' for the additional collection of liquid refrigerant and for more unobstructed flow of the homogeneous blend of refrigerant through that portion of the inlet manifold 10.

Figure 2:
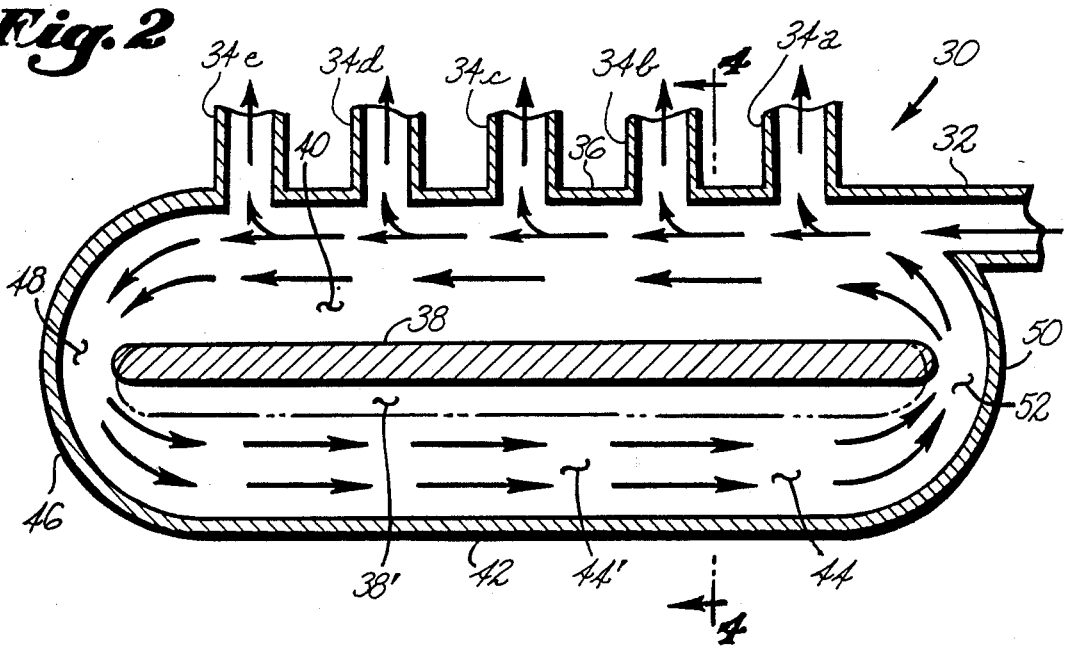
FIG. 2 is a longitudinal section view similar to FIG. 1 showing another embodiment of the invention with an alternate embodiment shown in phantom.
Figure 4:
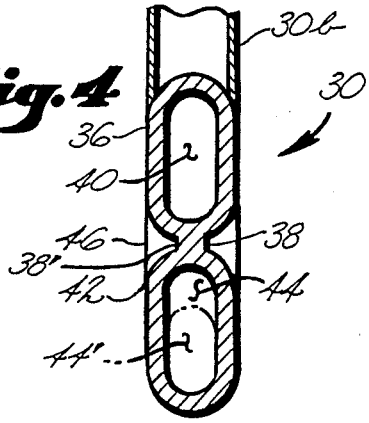
FIG. 4 is a section view in the direction of arrows 4—4 in FIG. 2.

Referring now to FIGS. 2 and 4, another embodiment of the invention is shown generally at numeral 30 which also includes an inlet 32 which receives refrigerant in the direction of the arrow from the liquid refrigerant expansion device such as an expansion valve or a capillary tube (not shown) as previously described. In this embodiment 30, a central partition 38 is provided between first and second tubular portions 36 and 42 which produce first and second passageway portions 40 and 44, respectively, which are somewhat laterally elongated. Refrigerant thus passing in the direction of the arrows through first passageway portion 40 encounters restricted passageway portion 48 formed between curved wall 46 and one end of partition 38 and then encounters the enlarged second passageway portion 44. Thereafter, the refrigerant again encounters restricted passageway portion 52 formed between curved wall 50 and the other end of partition 38.

These restricted pathway portions 48 and 52 serve to further homogenize the refrigerant as it circulates in the direction of the arrows for use when exiting through outlets 34*a* . . . 34*e* upward and outward in the direction of the arrows.

Again, it is emphasized that the refrigerant flowing in circular fashion within the various embodiments of the inlet manifold during steady state operation of the air conditioning system thus achieves a high degree of homogeneity and blending of the liquid and gas states of the refrigerant which is evenly and uniformly distributed out of outlets 14*a* . . . 14*e* or 34*a* . . . 34*e* for parallel flow through the evaporator tubes.

Another embodiment of the invention is shown in phantom in FIGS. 2 and 4 wherein partition 38' is sized to create a smaller cross-section in second passageway portion 44'. By this arrangement, velocity and enhanced mixing of the refrigerant is achieved as it flows through this second passageway portion 44'.

It is here noted that the angular orientation of the inlet manifolds 10 and 30 may be vertical as shown in FIGS. 2 and 4, horizontal, or at any acute angle of orientation therebetween. Likewise, the invention may be oriented end-to-end either horizontally or at any acute angle up to vertical. This is so because of the homogeneous nature of the refrigerant as it flows through and around these various embodiments of the invention shown.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In an evaporator system for refrigeration systems having an evaporator coil with a plurality of evaporator tubes and a refrigerant supply means which discharges compressed and liquefied refrigerant into and then through an expansion device, the improvement comprising:

an inlet manifold having an inlet operably connected to the evaporator expansion device and a plurality of outlets operably connected to the plurality of evaporator tubes whereby refrigerant discharging from the expansion valve is conveyed by said inlet manifold into the plurality of evaporator tubes;

said inlet manifold forming an endless refrigerant passageway having a generally flattened and elongated "O"-shape including first and second portions;

said first portion spaced apart and generally coextensive with said second portion, said inlet manifold inlet at one end of said first portion and said plurality of inlet manifold outlets laterally extending from said first portion.

2. An evaporator system for refrigeration systems as set forth in claim 1, wherein:

said first and second portions of said passageway are generally uniform along their length and equal to one another in cross section.

3. An evaporator system for refrigeration systems as set forth in claim 1, wherein:

said first and second portions of said passageway are generally uniform along their length and said second passageway cross section is different than said first portion cross section.

4. An evaporator system for refrigeration systems as set forth in claim 1, wherein:

said plurality of evaporator tubes extend along substantially the entire length of said inlet manifold.

5. In an evaporator system for refrigeration systems having an evaporator coil with a plurality of evaporator tubes and a refrigerant supply means which discharges compressed refrigerant into and then through a liquid refrigerant expansion means, the improvement comprising:

an inlet manifold having an inlet operably connected to the refrigerant expansion means and a plurality of outlets operably connected to the plurality of evaporator tubes whereby refrigerant discharging from the refrigerant expansion means is conveyed by said inlet manifold into the plurality of evaporator tubes;

said inlet manifold having an elongated, endless refrigerant passageway having an elongated straight first portion for refrigerant flowing one direction and a straight second portion spaced apart from and generally coextensive with said first portion for reverse flow of refrigerant;

said first portion having an inlet at one end for receiving refrigerant from the refrigerant expansion means;

said first and second portions operably connected to one another at each end to allow refrigerant entering said first portion inlet to circulate around said passageway through said first portion in one direction, into said second portion and therethrough in the opposite direction and returning into said first portion adjacent said first portion inlet;

said first portion including said plurality of said inlet manifold outlets extending generally transversely therefrom whereby a portion of the refrigerant flowing through said first portion exits said inlet manifold outlets.

6. An evaporator system for refrigeration systems as set forth in claim 5, wherein:

said first and second portions of said passageway are generally uniform along their length and equal to one another in cross section.

7. An evaporator system for refrigeration systems as set forth in claim 5, wherein:

said first and second portions of said passageway are generally uniform along their length and said second passageway cross section is greater than said first portion cross section.

8. An evaporator system for refrigeration systems as set forth in claim 5, wherein:

said plurality of evaporator tubes extend along substantially the entire length of said inlet manifold.

* * * * *